US005762470A

United States Patent [19]

Gelmedov et al.

[11] Patent Number: 5,762,470

[45] Date of Patent: Jun. 9, 1998

[54] ANTI-STALL TIP TREATMENT MEANS

[75] Inventors: Fagim S. Gelmedov; Evgenij A. Lokshtanov, both of Moskovskaja; Lev Echielevich-Meerovich Olstain, Moskva; Michail A. Sidorkin, Ufa, all of Russian Federation

[73] Assignee: Central Institute of Aviation Motors (CIAM), Moscow, Russian Federation

[21] Appl. No.: 513,903

[22] PCT Filed: Mar. 11, 1994

[86] PCT No.: PCT/GB94/00481

§ 371 Date: May 2, 1996

§ 102(e) Date: May 2, 1996

[87] PCT Pub. No.: WO94/20759

PCT Pub. Date: Sep. 15, 1994

[30] Foreign Application Priority Data

Mar. 11, 1993 [RU] Russian Federation ..... 012990

[51] Int. Cl.[6] ..... F01D 11/08

[52] U.S. Cl. ..... 415/57.4; 415/119; 415/173.1; 415/173.5; 415/914

[58] Field of Search ..... 415/119, 173.1, 415/173.5, 173.6, 174.5, 186, 914, 208.2, 208.3, 208.5, 211.1, 57.4, 144; 60/39.29

[56] References Cited

U.S. PATENT DOCUMENTS

| | | | |
|---|---|---|---|
| 4,212,585 | 7/1980 | Swarden et al. . | |
| 4,466,772 | 8/1984 | Okapuu et al. | 415/173.5 |
| 4,540,335 | 9/1985 | Yamaguchi et al. | 415/914 |

FOREIGN PATENT DOCUMENTS

| | | |
|---|---|---|
| 0092955 | 11/1983 | European Pat. Off. . |
| 0348674 | 1/1990 | European Pat. Off. . |
| 722424 | 7/1942 | Germany . |
| 2458709 | 6/1975 | Germany . |
| 273364 | 10/1970 | U.S.S.R. . |
| 757774 | 8/1980 | U.S.S.R. . |
| 479427 | 1/1938 | United Kingdom . |

*Primary Examiner*—Christopher Verdier

*Attorney, Agent, or Firm*—Cushman Darby & Cushman Intellectual Property Group of Pillsbury Madison & Sutro LLP

[57] ABSTRACT

To delay the onset of stall conditions at the tips of the blading an of axial-flow, mixed-flow and axial-centrifugal compressors, at the tips of the annular arrays of blading anti-stall tip treatment arrangement is provided at least at one of the arrays (2) comprising an annular cavity (3) communicating with the flow path through the compressor through slots (5) formed by an annular grid of ribs (4). The slots (5) provide communication between the cavity (3) and the flow path (7, 8) both upstream of and axially coincident with the array of blades (2). The ribs (4) are inclined relative to the radial direction at an angle ($\phi_r$) of b 30° to 50°. The pitch (t) of the ribs and the slot width ($\delta_s$) between the ribs are in the ratio of 1.5 to 2.0. The rib radial projection height (h) and the slot width are in the ratio of 1.1 to 1.8. The axial length (L) of the grating of ribs and the blade tip chord axial projection (b') of the array of blades (2) are in the ratio of 0.5 to 1.5. The cavity height (H) outwardly of the ribs and the axial length of the grid are in the ratio of 0.2 to 0.5.

6 Claims, 2 Drawing Sheets

ANTI-STALL TIP TREATMENT MEANS

This application claims priority under 35 U.S.C. 371 based on PCT application PCT/GB94/00481, filed Mar. 11, 1994, published as WO94/20759 Sep. 15, 1994, which claims priority based upon Soviet Union Application 93-012990, filed Mar. 11, 1993.

The present invention relates to compressors and more especially to axial-flow, mixed-flow and axial-centrifugal compressors of gas turbine plant. It is particularly concerned with the provision of anti-stall tip treatment means in such compressors.

A centrifugal compressor is known (Soviet Union Author's Certificate No. 273364, published in 1970) which comprises a rotor and a casing closely surrounding the rotor. In the inlet section the compressor casing is provided with an annular cavity is extending over the radially outer edges of the rotor blades. The cavity connected through two adjacent annular passages to the compressor flow path immediately upstream of the rotor and to the leading edge region of the rotor blades. Each passage contains guide ribs circumferentially inclined in opposite senses to the radial direction.

Differences in the processes of gas compression and the designs of axial-flow, centrifugal, mixed-flow and compound compressors put specific requirements upon the construction of anti-stall tip treatment means. Therefore use of the tip treatment means described in the Author's Certificate No. 273364 does not ensure the efficient operation of a multistage axial-flow compressor or an axial-centrifugal compressor with axial first stages over a typical range of operating conditions.

An axial-flow compressor is known (Soviet Union Author's Certificate No. 757774, published in 1980) which comprises a casing with rotor and stator blades therewithin and an annular cavity disposed over the blades. The cavity communicates with the compressor flow path through slots between ribs defining a grid, the ribs being circumferentially inclined to the radial direction.

A disadvantage of this arrangement is that in order to prevent a reduction in compressor efficiency, it is necessary to provide an additional device in the form of a rotatable ring that considerably complicates the construction and reduces its reliability.

It is an object of the present invention to provide an anti-stall tip treatment in axial-flow, mixed-flow and axial-centrifugal compressors to increase the range of aerodynamic and/or aeroelastic stability of the blades while moderating any resulting loss in compressor efficiency. Another object of the invention is to provide a tip treatment against stall conditions that will vary its action without the use of additional control devices. A further object is to provide an anti-stall tip treatment that is relatively simple in construction.

According to the invention, there is provided a compressor comprising a casing in which are annular arrays of rotor blades and stator blades, the casing having an annular cavity extending over at least one said array of blades, the cavity communicating with the flow path through the compressor both upstream of and axially coincident with said array of blades through slots formed by an annular grid of ribs, said ribs being obliquely inclined relative to the radial direction at an angle ($\phi_r$) of 30° to 50°, the pitch (t) of said ribs and the slot width ($\delta_s$) between ribs being in the ratio of 1.5 to 2.0, the rib radial projection height (h) and the slot width being in the ratio of 1.1 to 1.8, the axial length (L) of the grating of ribs and the blade tip chord axial projection (b') being in the ratio of 0.5 to 1.5, and the cavity height (H) outwardly of said ribs and said axial length (L) of the grating being in the ratio of 0.2 to 0.5.

Preferably the ribs are obliquely inclined with respect to the flow direction through the compressor and this angle may vary along their length.

It is also preferred to arrange that the angle of rib inclination to the radial direction is constant along the length of the series of ribs.

For a better understanding of the present invention, reference will now be made to the accompanying drawings, in which.

Figure 1:
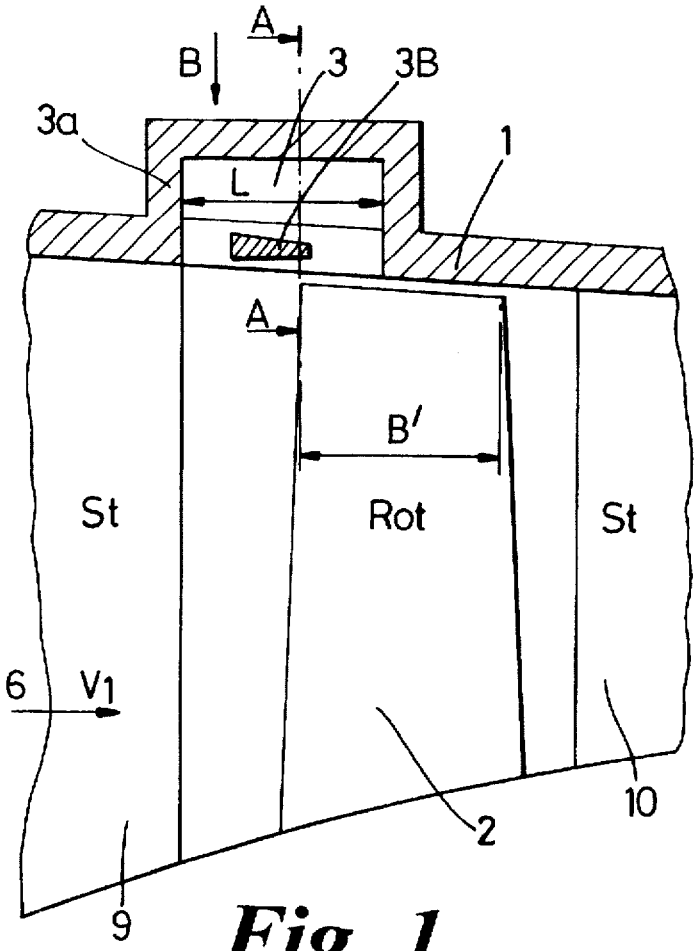
FIG. 1 is a partial longitudinal section of a compressor stage which incorporates an anti-stall tip treatment in accordance with one embodiment of the present invention.

The drawings show a portion of a casing 1 of a gas turbine axial flow compressor, and a rotor represented by one of a series of annular arrays of rotor, blades 2 mounted on a rotor shaft (not shown) extending centrally through the casing. Annular arrays of stator blades 9 and 10 respectively, are secured to the casing upstream and downstream of the array of rotor blades 2. To delay the onset of stall conditions at the tips of the rotor blades, anti-stall tip treatment means are provided adjacent the blade tips.

The treatment means in this example comprises an annular cavity 3 defined by a protruding U-shaped cross-section member 3*a* of the casing and an annular grid 3*b* of spaced ribs 4 between the cavity 3 and the compressor flow path 6 through the arrays of blading. The ribs 4 define a series of slots 5 of width 8 at through which there is communication between the cavity 3 and the flow path. The slots 5 overlap the rotor blade tips and flow path immediately upstream of the rotor blades, and the axial extent L of the cavity 3 corresponds to that of the slots.

Figure 2:
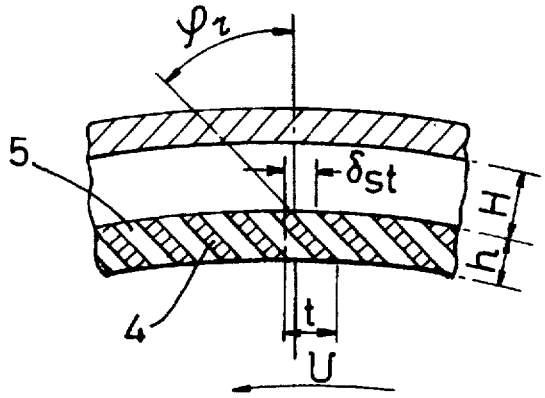
FIG. 2 is a cross-sectional view on line A—A in FIG. 1.
Figure 3:
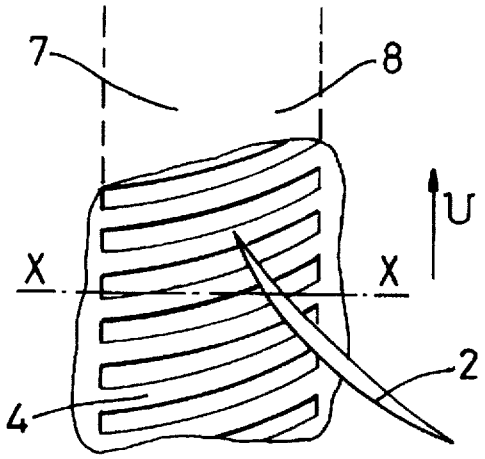
FIG. 3 is a view taken along arrow B in FIG. 1.
Figure 4:
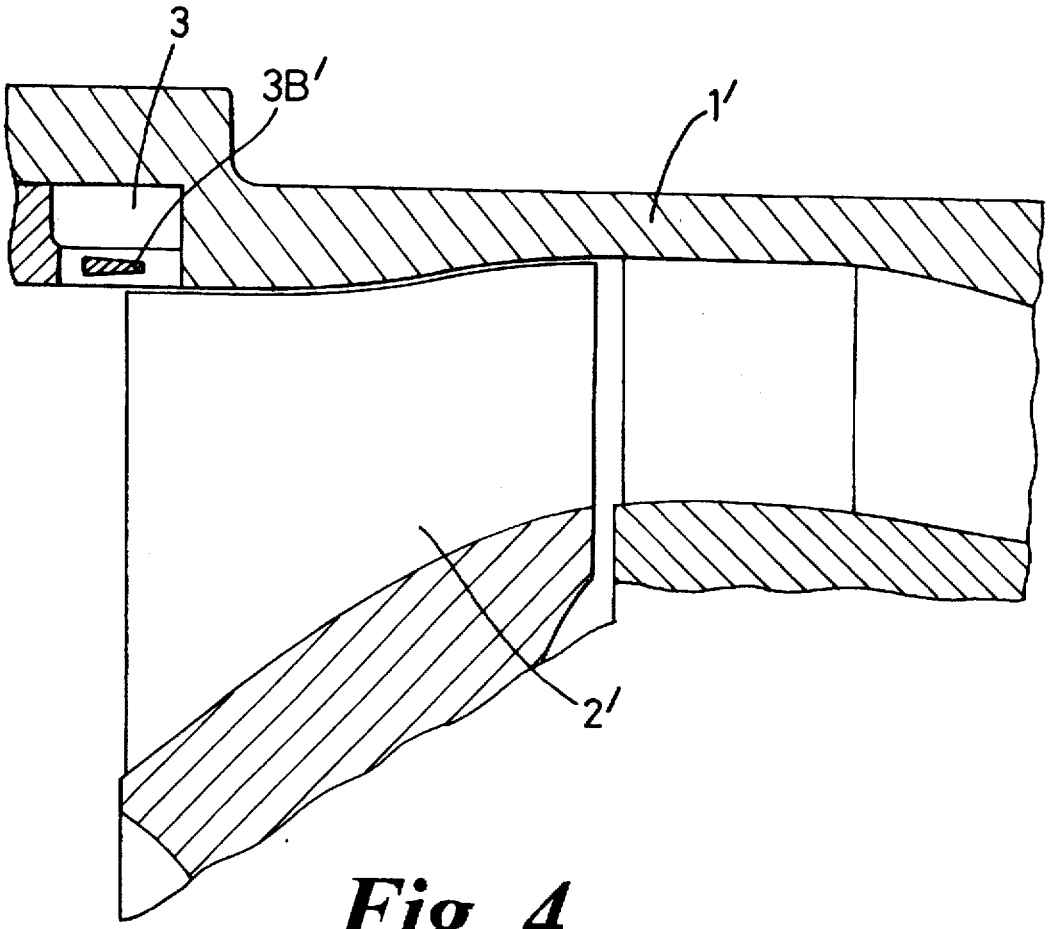
FIG. 4 is used similar to FIG. 1 but showing a mixed-flow compressor with the numerals primed to designate parts corresponding to those shown in FIG. 1.

As seen in FIG. 3, the ribs 4 and slots 5 extend parallel to each other. They are inclined outwardly in the direction of rotation U of the rotor blades 2 at an angle $\phi_r$ to the radial direction, as shown in FIG. 2. The angle $\phi_r$ is constant along the length of the tip treatment means in this example but it may vary. The axes of the ribs 4 and slots 5 are also inclined at an angle $\phi_a$ (FIG. 3) with respect to the direction of flow velocity $V_1$ upstream of the rotor blades 2, shown in FIG. 3 at an angle θ to the axial direction X—X. The angle $\phi_a$ is shown constant along the length of the tip treatment means but like the angle $\phi_r$ it may vary.

The values chosen for these angles depend on the direction of the flow upstream of the rotor blades 2, the shape of the compressor flow path and parameters of the stage. The angle $\phi_r$ should lie in the range 30° to 50°.

At optimal flow regimes in the flow path 6 in the region of the rotor blade array and with high;mass flow rates, the pressure in the forward section of interblade channel 8 does not exceed the pressure in the region 7 of the rotor blade upstream of the rotor blade array, so that there is no flow of air through the cavity 3 from the region of the rotor blades.

On the other hand, when the air flow rate exceeds an optimal value, the pressure gradient may cause air to be drawn into the cavity 3 through the slots 5 to flow from there into the flow path 6 in the rotor blade region. A decrease in the air flow rate through the compressor and an increase in the pressure downstream thereof, or a local decrease in flow velocity in the rotor tip region upstream of the rotor blades 2 cause an increase in the blade angles of incidence. Such conditions lead to a tendency for the pressure in the forward section of the interblade channel 8 to increase and exceed the pressure in the rotor tip region of the flow path upstream of the rotor blades 2. Because of the pressure difference, air begins to flow through the slots 5 of the tip treatment means disposed over the rotor blades, into the annular cavity 3 and from there into the flow path upstream of the rotor blades. This process generates a circulation flow in the rotor tip region of the flow path. The circulating air flow rate increases as the back pressure downstream of the rotor blades increases and as a result the angle of incidence in the tip region of the blades varies only slightly.

The use of the grid 3b with slots 5 inclined at the angle $\phi_r$ in the direction of rotation both over the rotor blades and upstream thereof contributes to an intensification of the circulation flow. This is due to the fact that when the air flows from the cavity 3 through the slots 5 into the flow path 6 upstream of the rotor blades, it is swirled in a direction opposite to the direction of rotor rotation, which improves the local suction capacity of the rotor tip region 8 and increases its head as a result of the negative flow swirl.

Thus, the annular cavity 3 serves as a bypass passage through which a reverse flow of air is transported out of the rotor blade region when the pressure downstream thereof exceeds some maximum value. Under incipient tip stall conditions it can therefore prevent discharge of this flow directly out of the rotor blade region into the entry flow path thereof.

The annular cavity 3 also serves to decrease any circumferential non-uniformity of pressure and reduce flow fluctuations caused by the rotating blades 2 passing the slots 5. It can also help to prevent the formation of discrete stall zones. The cavity height H is chosen in the range of 0.2 to 0.5 of the grid axial length L. A decrease of H below 0.2 L can reduce the tip treatment efficiency while an increase of H above 0.5 L does not improve the efficiency of the tip treatment means but increases its overall radial dimensions.

The efficiency of tip treatment can be expressed in terms of the displacement of the stage surge line relative to its initial position, versus flow coefficient ($\phi$=Ca/U);

$$\delta\phi = \left(\frac{\phi in - \phi tt}{\phi in}\right) \times 100\%$$

where

U is the speed of rotation of the rotor

Ca is the axial flow component $\phi$in is the stage flow coefficient in the surge line without tip treatment $\phi$tt is the stage flow coefficient on the surge line with tip treatment.

The effects on $\delta\phi$ of varying the parameters $\phi_r$, $\phi_a$, H/L, $h/\delta_{s,s}$ are illustrated by the example in the following table:

| | $\phi_r$ | | $\phi a$ | | H/L $\phi_r$ = 45° | | H/L $\phi_r$ = 0° | | | $h/\delta_s$ | | $t/\delta_s$ | |
|---|---|---|---|---|---|---|---|---|---|---|---|---|---|
| | 0° | 45° | 0° | −20° | 0 | 1.43 | 0.2 | 0.4 | 1.43 | 0.7 | 1.43 | 1.45 | 2.0 |
| $\delta\phi$% | 16 | 36 | 13 | 18 | 11 | 26 | 36 | 36 | 33 | 2.4 | 27 | 13 | 19 |

The optimum value of the length L is dependent on geometric and aerodynamic parameters of the rotor. For example, for a stage having a moderate head coefficient and blade aspect ratio AR (rotor blade height rotor blade chord) between 1.5 and 2.5, optimum L is approximately equal to b', the blade axial tip chord projection. For a stage with a large head and low aspect ratio, AR<1, optimum L is approximately 0.5 to 0.6 b.

All geometric parameters of the elements of the tip treatment means may be chosen to ensure maximum efficiency in near-stall and stall regimes and minimize any decrease of efficiency at optimal flow regimes. Thus, in order to reduce losses during the flow of air out of the rotor blade region into the annular cavity, the angle $\phi_r$ is calculated from the flow parameters in the rotor tip region such that it is close to the direction of the flow in cross-section. That is to say, $$\phi_r = \arctan\frac{Cu}{Cr}$$

(Cu and Cr being the circumferential and radial components of flow velocity, respectively), with parameters used in practice in the stages not beyond the specified range of 30° to 50°. When $\phi_r$ is below 30° losses due to the flow of air out of the rotor blade region into the annular cavity increase. When $\phi_r$ exceeds the upper limit of 50° there is an increase of losses in the flow of air from the annular cavity into the flow path upstream of the rotor.

The ratio of grating pitch t to slot width $\delta_{ss}$ is chosen in the range of 1.5 to 2.0. Reducing this ratio below 1.5 makes it necessary either to decrease the rib thickness, which can give an unacceptable reduction of strength under periodic loading, or to increase excessively the radial length of the ribs and the entire tip treatment means. A ratio significantly above 2.0 causes an increase of losses at air flow discharge out of the rotor blade region into the annular cavity and consequently a decrease in efficiency of the tip treatment means.

The ratio of the rib radial height h to slot width $\delta_{ss}$ is in the range 1.1 to 1.8. Below the lower limit of this ratio there is a decrease in grid solidity and even the lower limit is best used only in the lower part of the range of $\phi_r$. Increase of the ratio beyond the indicated upper limit can cause an increase in friction losses in the air circulation.

The grid axial length L may vary from 0.5 to 1.5 of the axial projection b of the rotor blade tip chord. Within this range, L may depend largely on the aerodynamic loading of a stage and the aspect ratio of its blades. Decrease of L below 0.5 has an adverse effect on the efficiency of the tip treatment means, and an increase above 1.5 is possible only by increasing the length of the treatment region extending over the flow path 6 upstream of the rotor blades, so is limited by the construction of the compressor elements upstream of the rotor blades, and does not result in an increase in tip treatment efficiency.

All the abovementioned geometric parameters and ratios are inter-related and also related to aerodynamic characteristics of the stages, in particular to relative motion Mach number. The choice of the tip treatment means parameters is therefore based on the aerodynamic design and the structural and technological features of the compressor in each specific case.

The tip treatment of the invention is also applicable to the stator blades, but at their radially inner ends. However, it is rare for compressor flow stability to be compromised by stator tip stall and the effects of the tip treatment are significantly less on stator blading.

We claim:

1. A compressor having a flow path and comprising a casing in which there are annular arrays of rotor blades, the casing having an annular cavity having a height (H) and extending over the tips of at least one said array of blades, the cavity communicating with the flow path through the compressor both upstream of and axially coincident with said array of blades through slots formed by an annular grid of ribs, said ribs being inclined obliquely relative to a radial direction of the compressor, characterized in that the ribs are inclined at an angle ($\phi_r$) of 30° to 50° to the radial direction of the compressor, that the pitch (t) of the ribs and the circumferential slot width ($\delta_s$) between adjacent ribs are in a ratio of 1.5 to 2.0, that the rib radial projection height (h) and said slot width are in a ratio of 1.1 to 1.8, that an axial length (L) of the grid of ribs and the blade tip chord axial projection (b') of said array of blades are in a ratio of 0.5 to 1.5, and that the cavity height (H) outwardly of said ribs and said axial length of the grid are in a ratio of 0.2 to 0.5.

2. A compressor as claimed in claim 1 wherein the ribs (4) are obliquely inclined with respect to the flow direction (V) through the compressor.

3. A compressor as claimed in claim 2 wherein said angle of rib inclination varies along the axial length of the grid (3*b*).

4. A compressor as claimed in any one of claims 1 to 3 wherein the angle of inclination of the ribs (4) relative to the radial direction is constant along the axial length of the grid (3*b*).

5. A compressor as claimed in claim 1 in the form of an axial flow compressor.

6. A compressor as claimed in claim 1 in the form of a mixed flow compressor.

* * * * *